US006276965B1

(12) United States Patent
Madsen et al.

(10) Patent No.: US 6,276,965 B1
(45) Date of Patent: Aug. 21, 2001

(54) SHIELDED I/O CONNECTOR FOR COMPACT COMMUNICATIONS DEVICE

(75) Inventors: Brent D. Madsen, Providence, UT (US); Margaret Wong, Richmond; TG Hien, San Jose, both of CA (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/318,389

(22) Filed: May 25, 1999

(51) Int. Cl.[7] ..... H01R 13/648
(52) U.S. Cl. ..... 439/607; 439/108
(58) Field of Search ..... 439/607–610, 439/76.1, 101, 108

(56) References Cited

U.S. PATENT DOCUMENTS

| | | | | |
|---|---|---|---|---|
| 4,037,914 | | 7/1977 | Fetzer . | |
| 4,679,879 | * | 7/1987 | Toriner et al. | 439/607 |
| 4,789,847 | * | 12/1988 | Sakamoto et al. | 439/607 |
| 5,295,867 | * | 3/1994 | Bethurum | 439/607 |
| 5,547,397 | * | 8/1996 | Hirai | 439/607 |
| 5,696,669 | * | 12/1997 | Bassler et al. | 439/607 |
| 5,928,035 | * | 7/1999 | Jankowsky et al. | 439/607 |
| 5,989,042 | | 11/1999 | Johnson et al. . | |

* cited by examiner

*Primary Examiner*—Hien Vu
(74) *Attorney, Agent, or Firm*—Workman, Nydegger & Seely

(57) ABSTRACT

An input/output (I/O) media connector for a reduced sized communication cards. A metallic shield is wrapped substantially about the connector and secured to the connector by a plurality of pins integral with the connector. The shield has a plurality of tabs securely connected and grounded to a printed circuit board (PCB) that is interposed between the top and bottom covers of a compact flash card. Since the connector shield is securely connected and grounded to the PCB, the shield reflects and/or absorb the electromagnetic radiation emitted by the connector. Further, a plurality of cantilever beam springs integral with the shield, and biased towards the covers of the compact flash card, serve to ensure that the shield remains in substantial physical contact and electrical communication with the metallic covers of the compact flash card. Because the covers of the compact flash card are bonded and grounded with both the PCB and the shield, the covers are grounded and thus also reflect and/or absorb the harmful electromagnetic radiation emitted by the PCB and connector. The connector has an aperture formed in it to receive a media plug; the aperture is so formed as to preclude insertion of electrically non-compatible media plugs. Finally, the connector has an integral beam which terminates in a free end that occupies at least a portion of the aperture when the media plug is not present. The beam has a protruding retainer portion that mates with a corresponding recess formed on a tongue that is integral with the media plug. The beam and tongue arrangement provides tactile and audible feedback which ensure that the user is aware when the media plug is properly secured within the connector. This arrangement also exerts a retention force sufficiently large to preclude inadvertent removal of the plug.

10 Claims, 4 Drawing Sheets

SHIELDED I/O CONNECTOR FOR COMPACT COMMUNICATIONS DEVICE

BACKGROUND OF THE INVENTION

1. The Field of the Invention

The present invention relates generally to electrical connectors. More particularly, embodiments of the present invention relate to an improved electrical connector that is electromagnetically shielded and provides for a secure, low-profile physical/electrical connection with a mating media plug.

2. The Relevant Technology

The demand for personal computers and related equipment continues to expand due to a number of factors. One important factor is in that the prices of computers continues to decline. Another factor is the expansion and development of the Internet and related network communications. More and more commercial and non-commercial enterprises are conducting business via the Internet and consumers need personal computers to gain access to the products and information that are available on the Internet.

In addition to being more affordable, advances in computer application software, operating systems and communications software has fueled the development of computers having greater processing speeds and capacities. At the same time, the pressure to at least maintain, or preferably reduce, the physical size of the computer has increased as well. Accordingly, downsizing and miniaturization of computer components is an issue of great importance in the industry.

In an effort to reduce the form factor of the typical personal computer, and yet expand the capabilities of that computer, manufacturers began to develop miniature portable expansion devices having smaller sizes, such as add-on memory cards and modems. The typical expansion device was designed to plug into a port or socket on the main computer; thus the expansion device served to expand the capability of the computer without significantly increasing the size of the computer's physical envelope.

While the development of portable expansion devices represented a significant advance in the capabilities of personal computers, one drawback of many of the devices was that they were designed to fit only one manufacturer's computer, and thus were not interchangeable between platforms. The industry recognized that standardization of these devices would, among other things, greatly increase the demand for them. To this end, several manufacturers collaborated to form the Personal Computer Memory Card International Association (PCMCIA). This body developed and promulgated standards for the physical design, dimensions, and electrical interface of expansion devices. Now, many computers being manufactured, especially those having a reduced size, are adapted to accommodate these standards.

PCMCIA cards have become very popular because of their relatively small size, interchangeability, and capability. However, as a result of the relentless drive for smaller and more capable computers, the industry has developed a new generation of expansion devices with an even smaller form factor than that of PCMCIA cards. The new expansion devices, or cards, are sometimes referred to as "compact flash" or "miniature flash" cards.

Some examples of the new devices include compact flash memory cards, which are solid state storage devices that may have a storage capacity as high as 40MB; modems; and local area network (LAN) cards. The new compact devices have a very small "form factor" or physical size. A typical compact flash card uses about 1550 $mm^2$(36 mm long×43 mm wide) of space on a circuit board. In contrast, a typical card built to PCMCIA standards uses almost three times as much circuit board space, or about 4644 $mm^2$ (86 mm long×54 mm wide).

Clearly, the compact flash form factor represents an important advancement in the art. However, the smaller form factor has also created some new problems that must be overcome in order that the maximum performance and reliability of the compact flash cards may be realized. Certain of these problems are particularly acute in those compact flash LAN cards that use a 4 pin input/output (I/O) connector. Some of the problems flowing from the use of the new form factor concern the construction and composition of the compact flash media card. Other problems concern the physical and electrical interfaces between the compact flash card and the various types of media cables used to carry media between the flash card and other devices.

One of the shortcomings common in current compact flash card designs concerns the harmful electromagnetic radiation produced by the card. Electromagnetic radiation is a natural consequence of current flow through the electrical circuits on the card. Unchecked, electromagnetic radiation can interfere with and disrupt the operation of electrical and electronic circuits in the host device. The interference resulting from electromagnetic radiation is commonly known as electromagnetic interference (EMI). Because electromagnetic radiation is a natural consequence of current flow, it cannot practically be prevented. Instead, emissions of the electromagnetic radiation must be controlled in order to prevent harmful EMI from resulting.

It is generally acknowledged that metal or metallic structures, if properly located and grounded, can be effective in controlling harmful electromagnetic radiation. Metals are effective in this regard because they generally have a low characteristic impedance which has the desirable characteristic of reflecting the high impedance electromagnetic radiation typically emitted by computers and related devices. By reflecting the electromagnetic radiation away from vulnerable circuits or devices, the metal thereby acts as a protective shield. Materials which can absorb electromagnetic radiation would be effective as well. However, typical compact flash cards are housed in a bay or enclosure, inside the host device, that is constructed of plastic or the like. The non-metallic enclosures are largely ineffectual in reflecting the electromagnetic radiation produced by the card. Furthermore, even though many compact flash cards employ metal covers, those covers are nevertheless inadequate to reflect electromagnetic radiation. This is due to the fact that effective EMI control cannot be achieved unless the metal covers typically utilized in compact flash cards are electrically bonded together and grounded. Since the metal covers of typical compact flash cards are not bonded and grounded, those covers are generally of little use in preventing PCB-generated EMI.

While it is clear that there are unresolved concerns regarding EMI and the construction of the compact flash cards, EMI problems are not limited solely to the card itself. As suggested earlier, some of the problems flowing from the new compact flash form factor relate to the physical/electrical interface used to connect a media cable to the card.

In particular, the current flowing through the media cable and the physical/electrical interface, or I/O connector, generates electromagnetic radiation which, in turn, causes harmful EMI. Many of the connectors currently in use with the compact flash card, including the 4 pin connectors, lack any device or means to reflect or absorb the electromagnetic radiation produced by the connector. Thus, when a media plug at the end of the media cable is inserted into the compact flash card connector, the unchecked electromagnetic radiation that is produced as a result of current flow through the connector, acts to interfere with the operation of electrical and electronic components inside the compact flash card and in the host device.

Not only are the typical compact flash card I/O connector designs ineffectual in preventing harmful EMI, those connectors suffer from other shortcomings as well. A significant problem concerns the structural configuration of the typical connector. In particular, the physical shape of the receiving portion, or aperture, of the connector, i.e., the portion that receives a mating media plug, is such that the connector can readily accommodate modular plugs. For instance, the connector may be capable of receiving a modular plug from a telephone line or a network line. This can give rise to a significant problem if the compact flash card comprises a LAN card, for instance, which is inadvertently connected to a telephone line. In particular, the telephone ring voltage that is applied to a modem line could damage the electronics on a LAN card. Thus, because a user may not always be able to readily ascertain whether a particular connector is a modem card connector or a LAN card connector, it would be relatively easy for a user to inadvertently plug a modem cord into the connector typically used with compact flash LAN cards, and thereby expose the LAN card to harmful telephone ring voltages.

Finally, in addition to their structural deficiencies and the EMI problems that they present, the typical compact flash card I/O connector suffers from an insubstantial and ineffectual mechanical interface with media plugs. Again, this problem results from the small physical size of the card or peripheral, which also limits the size and functionality of any connector that is used. In particular, larger connector schemes provide a more robust and functional retention scheme for maintaining a connection. Moreover, the connectors also provide a user with a tactile "feedback" that indicates when a plug has been satisfactorily received by a connector. In contrast, miniaturized connector schemes provide less physical space in which to provide a satisfactory retention mechanism and any sort of tactile feedback.

For example, a significant problem with existing compact flash I/O connector retention mechanisms is that the contact area between the retaining portion of the receptacle and the retained portion of the plug, respectively, is relatively small. Accordingly, the forces required to insert and withdraw the mating media plug are correspondingly small. Small insertion and withdrawal forces are problematic at least partly because they fail to provide the audible and tactile feedback necessary to indicate to the user that the media plug has engaged the receptacle portion of the connector. Indeed, the feedback provided by typical mechanisms is oftentimes so minimal—as low as 1 to 2 pounds—that the user cannot be certain that latching has occurred. Finally, an implicit and undesirable consequence of small insertion and withdrawal forces is that the media plug is likely to be inadvertently removed from the connector even during normal use.

In view of the foregoing problems with miniaturized peripherals, such as compact flash cards, and their associated I/O connectors, what is needed is an improved shielded I/O connector that can be used with compact flash card-sized devices, such as LAN cards and modem cards. Specifically, the connector should be able to reflect and/or absorb the electromagnetic radiation produced by the connector when current flows through the connector. Further, the connector should be grounded and should be capable of physically and electrically connecting the top and bottom covers of the housing of a compact flash card so that the covers can function effectively as a shield against the electromagnetic radiation emitted by the PCB. Additionally, the connector should be configured in such a way as to ensure that a particular compact flash card is only connectible with media plugs, cables, devices, and the like, that are electrically compatible therewith. Also, the connector should provide a tactile and audible feedback that indicates to the user that the mating media plug is properly received and seated within the connector. Moreover, the retention force exerted by the connector on the received plug should resist at least some inadvertent withdrawals of the plug during normal use.

BRIEF SUMMARY AND OBJECTS OF THE INVENTION

The present invention has been developed in response to the current state of the art, and in particular, in response to these and other problems and needs that have not been fully or completely solved by currently available compact flash cards and compact flash card media connectors. Thus, it is an overall object of the present invention to provide an electrical connector that has a low profile and is particularly useful in devices and peripherals implemented in reduced-size form factors, such as that by the compact flash card. It is another object of the present invention to provide a shielded I/O connector that meets or exceeds Federal Communications Commission (FCC) Class B electromagnetic radiation emission standards. It is a further an object of the invention to provide a shielded I/O connector that is electrically grounded so as to facilitate prevention of connector-generated EMI. Another object of the invention is to provide a shielded I/O connector that is electrically bonded and grounded with the metal covers of a peripheral device, such as a compact flash communication card, so as to facilitate prevention of PCB-generated EMI. It is also an object of the present invention to provide a shielded I/O connector having a receiving portion calculated to prevent insertion of, and electrical communication with, electrically non-compatible media plugs that could harm the electronics within the reduced-size device. A further object of this invention is to provide a shielded I/O connector that has a retention mechanism that provides a high level of audible and tactile feedback so as to assure the user that the media plug is securely seated therein. It is a related object to provide a shielded I/O connector having a biased retention beam formed therein that is well-adapted to exert a substantial retention force on the corresponding tongue of a mating media plug.

In summary, the foregoing and other objects, advantages and features are achieved with an improved shielded I/O connector for use in connecting media cables and the like to reduced-size peripherals implemented within PCMCIA cards, compact flash cards and the like, such as modems and LANS (network interface cards—NICS). Embodiments of the present invention are particularly suitable for use with such peripherals that are used in a typical personal computer (PC) having one or more sockets or bays designed to accommodate the PCMCIA or compact flash card form factor. For instance, a compact flash card having the shielded I/O connector is inserted into the socket or bay in such a way that the shielded connector is readily accessible for insertion of a media plug or the like therein. Typically, such devices find particular application in portable computing equipment, such as laptop/notebook computers, handheld computers, personal organizers, etc.

In a preferred embodiment, a compact flash card having LAN functionality includes a four pin I/O connector wherein each of the respective first ends of the pins are removably attachable to a corresponding electrical contact in the media plug, and each of the respective second ends of the pins is secured to a printed circuit board (PCB) enclosed within the housing of the compact flash card. An EMI shield constructed of metallic material or the like is wrapped substantially around the connector so as to substantially reflect and/or absorb electromagnetic radiation emitted by the connector, and thereby minimize connectorgenerated EMI. Preferably, the connector comprises a plurality of pins or the like which protrude through the shield to ensure that the shield remains securely fixed thereto. In a preferred embodiment, a bottom portion of the shielded connector is inserted into an opening in the PCB, which is disposed between the top and bottom covers of the compact flash card. The connector is suspended in the opening by at least two shielded lugs which extend outwardly from the connector past the edges of the opening in the PCB. The shield portions of the tabs are secured to electrical contacts on the surface of the PCB, thereby ensuring physical contact and electrical communication between the shield and the PCB circuitry. The PCB circuitry is connected to a chassis ground thereby grounding the shield. The shield further comprises a plurality of resilient conductive members that function to maintain physical and electrical contact between the shield and the top and bottom covers of the compact flash card. In a preferred embodiment, the resilient conductive members comprise a plurality of cantilever beam spring contacts, which are biased toward the covers of the compact flash card. The spring contacts are electronically conductive, and thereby electrically connect the compact flash card covers to PCB chassis ground. By electrically connecting and grounding the flash card covers, the connector shield effectively transforms the flash card covers into a unified shield capable of containing and/or absorbing the electromagnetic radiation emitted by the PCB contained inside the card.

The shielded I/O connector body also preferably defines an aperture to receive a media plug. The aperture is preferably shaped so as to preclude insertion of electrically incompatible media plugs. This feature prevents the inadvertent attachment of plugs that contain electrical signals that could damage electronics within the card. In a preferred embodiment, the connector further comprises an integral beam which terminates in a free end that occupies a portion of the aperture when the media plug is not present. The beam has a protruding retention portion that fits into a corresponding mating recess on the surface of a tongue that is integrally formed in the media plug. The downward bias of the beam and the respective mating portions of the beam and tongue serve to impose a retention force on the media plug that prevents inadvertent withdrawal of the plug when mated with the connector. The retention mechanism, and the force imposed thereby, also provide tactile and audible feedback to notify the user when the plug has been securely received within the connector.

These and other objects, features, and advantages of the present invention will become more fully apparent from the following description and appended claims, or may be learned by the practice of the invention as set forth hereinafter.

BRIEF DESCRIPTION OF THE DRAWINGS

In order to more fully understand the manner in which the above-recited and other advantages and objects of the invention are obtained, a more particular description of the invention will be rendered by reference to specific embodiments thereof which are illustrated in the appended drawings. Understanding that these drawings depict only typical embodiments of the invention and are not therefore to be considered to be limiting of its scope, the invention in its presently understood best mode for making and using the same will be described and explained with additional specificity and detail through the use of the accompanying drawings in which.

DETAILED DESCRIPTION OF THE PREFERRED EMBODIMENTS

Reference will now be made to figures wherein like structures will be provided with like reference designations. It is to be understood that the drawings are diagrammatic and schematic representations of presently preferred embodiments of the invention, and are not to be construed as limiting the present invention, nor are the drawings necessarily drawn to scale. In general, the present invention relates to a low profile, shielded I/O connector for use with a peripheral device implemented within a card having a small form factor, such as a LAN or modem card that is incorporated within a compact flash form factor. FIGS. 1 through 8 show an example of a presently preferred shielded I/O connector for a compact flash LAN card constructed in accordance with the teachings of the invention. However, it will be appreciated that the connector could also be used with other similar devices having a reduced form factor.

Figure 1:
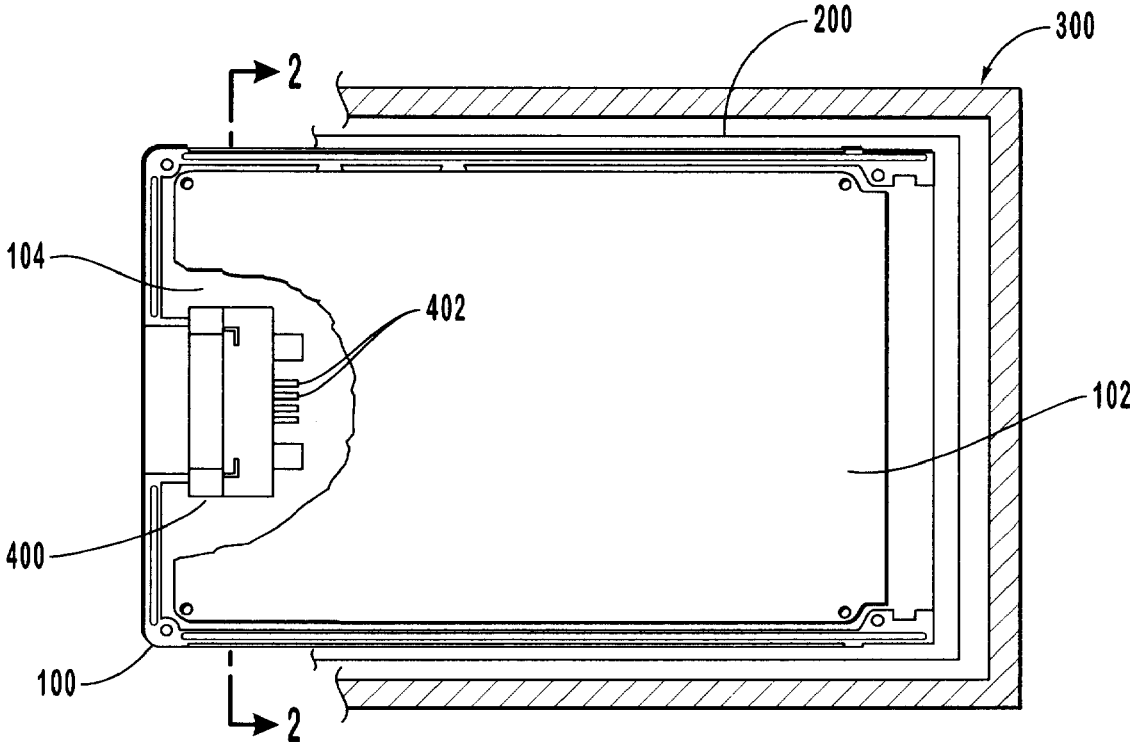
FIG. 1 is a general arrangement schematic showing the orientation of one preferred embodiment of a connector on a printed circuit board contained inside an example communications card.

Reference is first made to FIG. 1, which depicts a compact flash communications card 100 residing in the communications card bay 200 of a host device 300. A portion of the metal top cover 102 of the communications card housing is shown removed in order to more clearly indicate the arrangement and orientation of the shielded connector, indicated generally as 400, on the printed circuit board (PCB) 104. One end of the shielded connector 400 includes a plurality of electrical leads, or pins 402. The respective first ends of the pins are connected to corresponding electrical contacts on the PCB. The respective second ends (FIG. 4) of the pins are removably attachable to corresponding electrical contacts in a mating media plug (FIG. 4), which is received in the opposite end of the connector.

Figure 2:
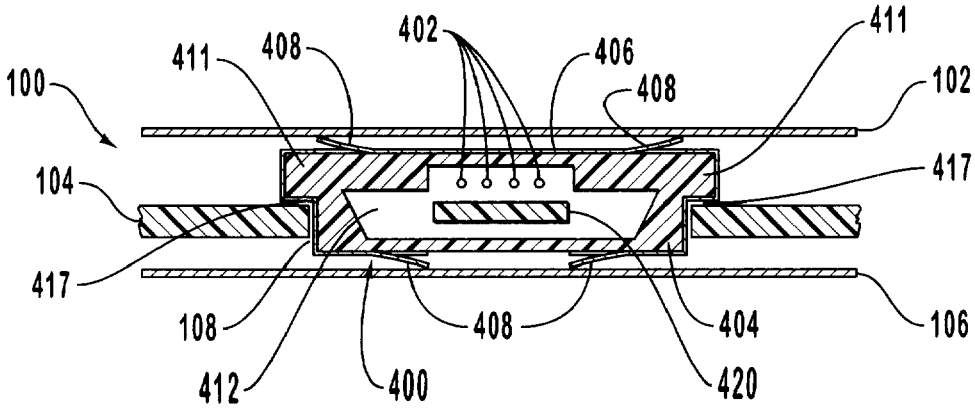
FIG. 2 is a section cut through the communications card of FIG. 1 showing the orientation of the connector and shield with respect to the printed circuit board and to the covers of the communication card.
Figure 3:
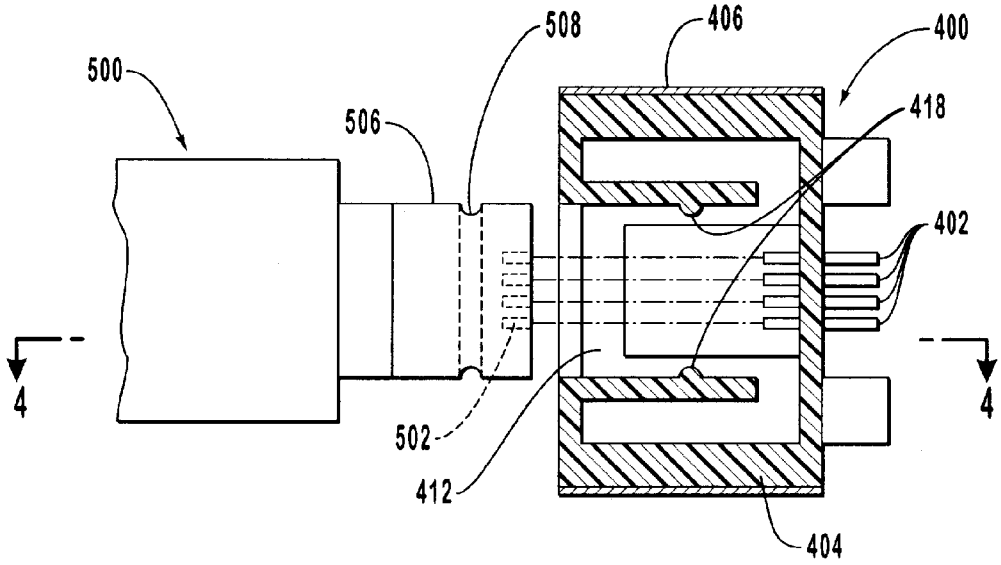
FIG. 3 is a plan view of the connector of FIG. 1, with the top removed, indicating the retaining bumps formed in the connector, and indicating the mating recesses formed on the media plug.
Figure 4:
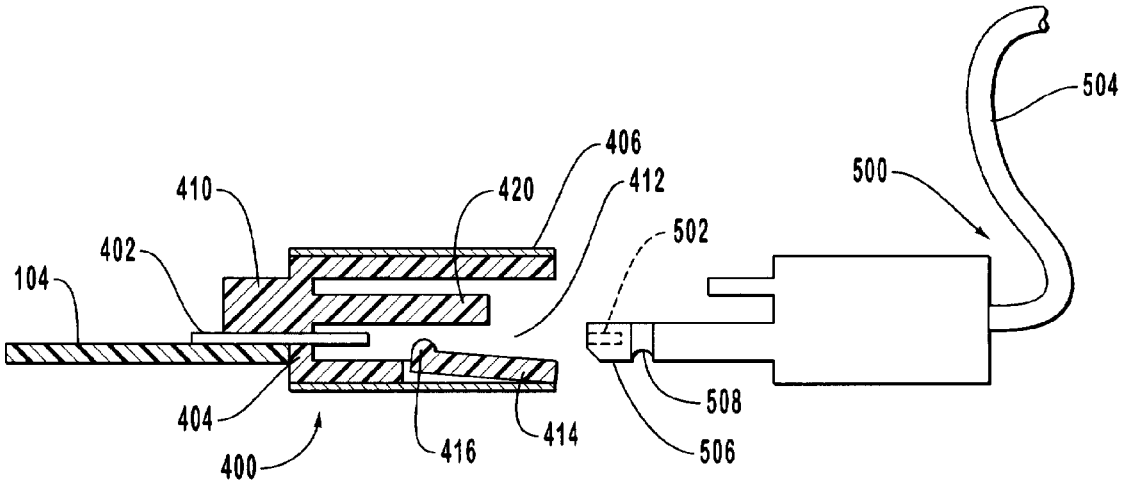
FIG. 4 is a section cut through the connector showing the interface between the biased beam of the connector and the mating recess on the tongue of the media plug.
Figure 6:
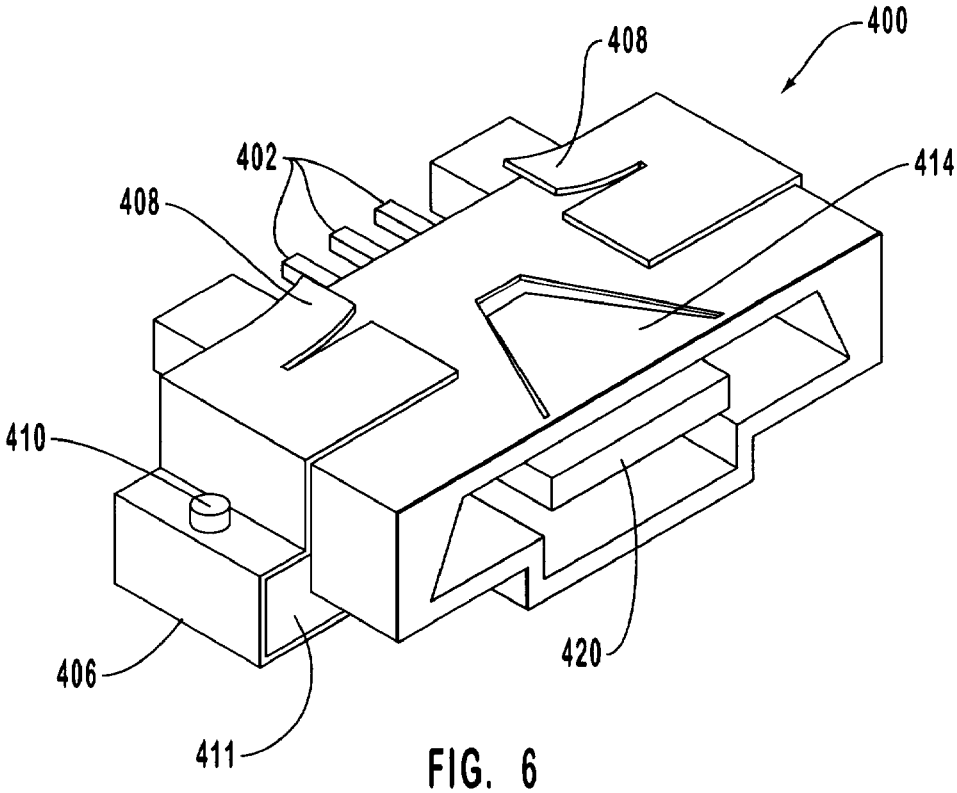
FIG. 6 is a bottom perspective view of the connector.
Figure 7:
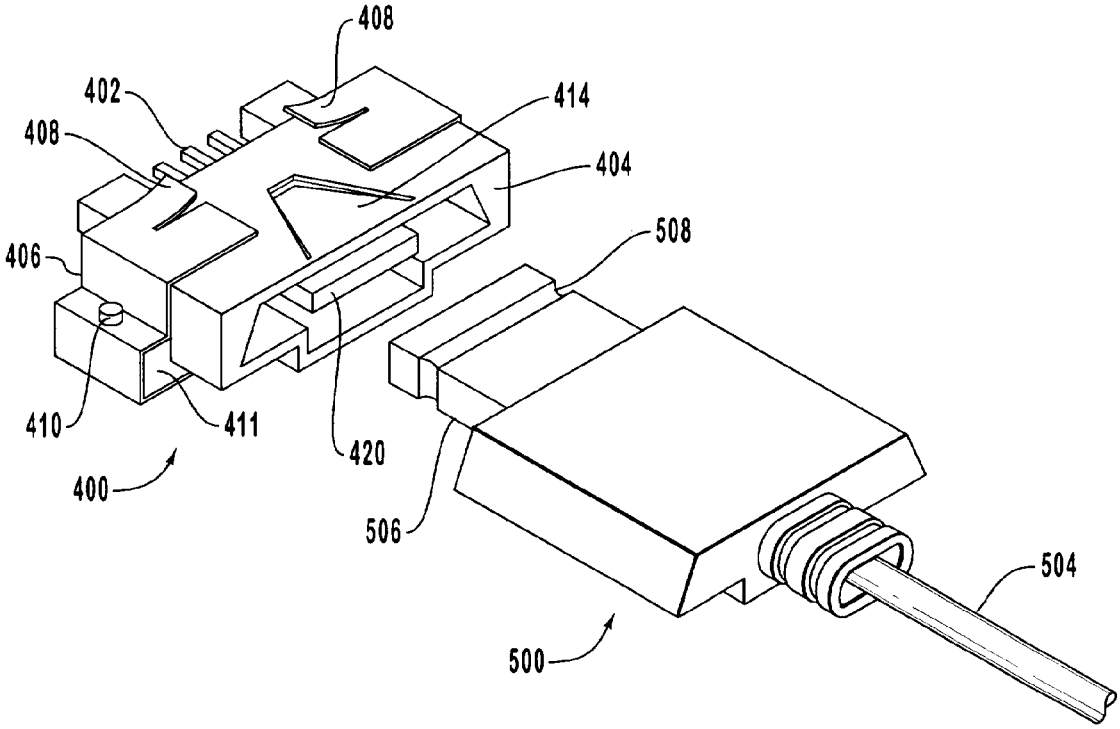
FIG. 7 is a bottom perspective view of the connector system.
Figure 8:
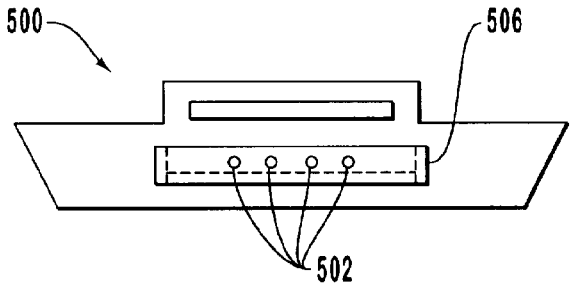
FIG. 8 is a front elevation view of the exemplary media plug of FIG. 7.

Reference is next made to FIG. 2 which illustrates a section cut through the communications card 100. The connector 400 and the PCB 104 are interposed between the metal covers 102, 106 which together form a housing of the communications card 100. The connector 400 includes a connector body 404 and a shield 406 wrapped substantially therearound. Note that while the preferred embodiment of the present invention discloses a shield constructed of metal, this invention also contemplates the use of any electrically conductive shielding, including but not limited to, shielding which only partially comprises metallic material or other conductive material, and shielding which comprises combinations of metallic material and other conductive material. The shield 406 includes a plurality of resilient conducting members 408, described in further detail below, and is retained in place on the connector by a plurality of pins 410 (FIGS. 6 and 7). Finally, as discussed further below, the shield 406 is electrically grounded to reduce connector-generated EMI.

With continued reference to FIG. 2, the bottom of the shielded connector 400 extends through an opening 108 in the PCB 104. A plurality of lugs 411 extend from the upper portion of the shielded connector body 400 and suspend the connector body in the opening. The shielded lugs 411 are secured to electrical contacts 417 on the surface of the PCB 104 which are in turn connected to a chassis ground (not shown). In this way, the shield 406 is also connected to ground.

The grounded shield effectively reduces connector-generated EMI. In particular, it was noted earlier that current flow through the pins 402 of the connector 400, produces electromagnetic radiation which causes EMI if not controlled. The shield 406 is located on the connector 400 so as to be directly in the path of the emitted radiation and is thus able to reflect and/or absorb that radiation, thereby facilitating reduction of harmful EMI. Note that different metallic materials and conductors may have different characteristic impedances; it is the characteristic impedance of the shield material that determines the relationship between the amount of radiation reflected by the shield and the amount absorbed by the shield. Of course, the total amount of conductive material in a particular shield will also bear on the capability and capacity of the shield to reflect and/or absorb electromagnetic radiation. Since reflection and absorption of electromagnetic radiation can both be effective methods of controlling EMI, embodiments of the invention contemplate the use of electrically conductive shielding materials which may be reflective only, or absorptive only, or which may control electromagnetic radiation through various combinations of reflection and absorption.

Not only does the connector shield 406 substantially prevent connector-generated EMI, but the shield 406 also interconnects and grounds the metal covers 102, 106 of the communications card 100, thereby transforming the covers of the communications card 100 into an effective shield against PCB-generated electromagnetic radiation. As illustrated in FIG. 2, the PCB 104 is located between the metal covers 102, 106 of the communications card 100. Like the connector shield 406, the metal covers 102, 106 of the card are located directly in the path of the emitted electromagnetic radiation. Thus the covers are able to reflect and/or absorb that radiation and substantially reduce PCB-generated EMI. However, as pointed out earlier, a structure or structures cannot be effective as an EMI shield unless those structures are grounded. Thus, the resilient conducting members 408 of the connector shield 406 are biased towards the covers 102, 106 of the communications card in order to ensure that the shield 406 remains in constant and substantial contact with the covers 102, 106 of the communications card 100. Moreover, the covers 102, 106 of the communication card 100 are electrically grounded because they are in electrical communication with the connector shield 406, which is connected to the PCB 104 chassis ground.

Reference is next made to FIGS. 3–8 which together illustrate in further detail other aspects of a preferred embodiment of the present invention. The connector 400 mates with a media plug, indicated generally as 500. One end of the media plug 500 includes a plurality of electrical contacts 502 therein, which form a detachable electrical contact with the corresponding pins 402 when the media plug 500 is received within connector 400. The electrical contacts 502 in the media plug 500 are also in electrical communication with the conducting elements (not shown) of the media cable 504 (FIGS. 4 and 7) that is received in the opposing end of the media plug 500.

In a preferred embodiment, the connector and media plug include means for detachably engaging the plug within the aperture the the two are operably mated. Preferably, this engagement means secures the plug within the aperture in a tight fitting, yet detachable manner. Moreover, the engagement means should provide an audible "click" that indicates when the plug has been operably engaged within the connector. As is shown by way of example in FIG. 4, the engagement means is comprised of an integral tongue 506 that extends out from the media plug 500. The tongue 506 has at least one recessed portion 508 formed on its outer surface. The tongue 506 of the media plug 500 is received into an aperture 412 defined by the connector 400. The connector 400 includes an integral beam 414, preferably triangular in shape (FIGS. 4 and 6), that is biased inwardly so as to provide interference with the media plug 500 when present within the aperture 412.

Note that while this embodiment teaches a resilient beam 414 biased upwards from the bottom of the connector into the aperture 412, the beam could also be located at the top of the connector and biased downward into the aperture, or alternatively, a beam or beams could be located on the sides of the connector and biased into the aperture.

Referring again to FIGS. 3 and 4, the beam 414 has at least one protruding retention portion 416 that is sized and shaped so as to detachably mate with the recessed portion 508 of the integral tongue 506 when the media plug 500 is fully inserted into the connector 400. In a preferred embodiment, the connector 400 also includes retention portions 418, which are also sized and shaped so as to detachably mate with recessed portion 508. While this embodiment of the invention indicates a recess on the media plug tongue and a retention portion on the beam of the connector, it is also contemplated that a connector system employing the reverse arrangement, that is, a recess on the beam and a retention portion on the plug, would be equally effective.

In addition to the beam, the connector 400 further includes a media plug seating platform 420 which cooperates with the biased beam 414 to effectively pinch the tongue 506 when the tongue is inserted therebetween. By pinching the tongue, the seating platform and the beam thus ensure that the retention portions 416 and 418 remain securely seated in the mating tongue recess 508 until a predetermined withdrawal force is exerted on the media plug. In a preferred embodiment, the predetermined withdrawal (and insertion) force is in the range of about 4 to about 5 pounds, although other forces could be used. The tongue/beam retention arrangement has the additional desirable characteristic of providing both audible and tactile feedback to notify the user the moment that the tongue has securely seated in the connector 400.

Figure 5:
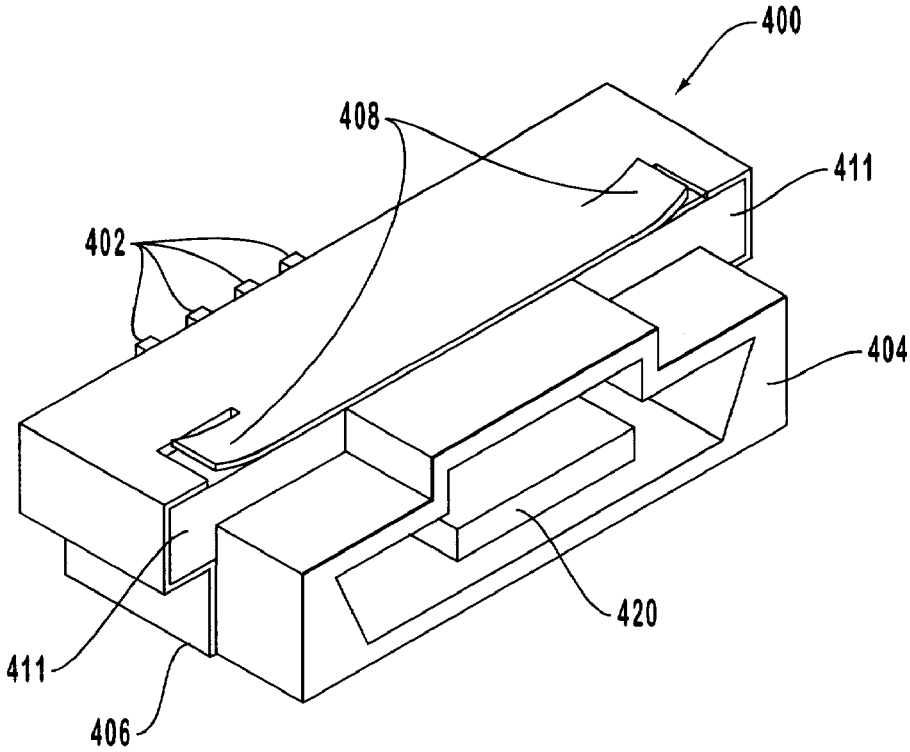
FIG. 5 is a top perspective view of the connector.

Reference is next made to FIGS. 5–7 which illustrate the shielded I/O connector 400, and the aperture defined thereby for receiving the media plug 500. As noted in the summary of the invention section, one of the preferred embodiments of the present invention is a compact flash LAN card with a shielded I/O connector. LAN cards are similar to modem cards, another preferred embodiment of the present invention, in that both facilitate transmission of data to and from a device or devices. However, LAN cards are susceptible to damage from the telephone ring voltages that are typically experienced by modem cables, plugs, and cards. Accordingly, FIGS. 5–7 indicate a connector having an aperture formed generally in the shape of a truncated "V" (when the connector is oriented as shown in FIG. 5). The "V" configuration is calculated to preclude insertion of a typical modem media plug, which frequently takes the form of a truncated "A." Note that the small rectangular portion of the aperture, located above and adjacent to the truncated "V" portion, would prevent a user from accidentally flipping the truncated "A" upside down and inserting it into the "V" aperture. Finally, this invention contemplates a truncated "A" configuration aperture where the compact flash card comprises a modem card, one of the embodiments disclosed herein.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An electrical communications card for use in providing detachable physical coupling and electrical communication between an electronic device and a media plug of a communications system, the card comprising:

(a) a printed circuit board disposed between an upper and a lower conductive cover, the printed circuit board having a ground conductor;

(b) a connector at least partially disposed between the upper and lower covers, the connector comprising:

(i) a connector body, the connector body defining an aperture that is sized and shaped so as to detachably receive at least a portion of the media plug;

(ii) a beam terminating at a free end that is biased in a direction so as to be at least partially disposed within the aperture;

(iii) a retention portion formed on the free end of the beam;

(iv) a platform extending within the connector aperture opposite the retention beam;

(v) at least one electrical lead having a first end electrically connected to the printed circuit board, and a second end that is placed in electrical contact with the media plug electrical conductor when the plug is received with the aperture; and (vi) an electromagnetic interference shield wrapping substantially around the connector body and fixed to the connector body so as to leave the aperture of the connector body exposed to receive the media plug;

(c) a plurality of conductive members that are positioned on the connector so as to physically contact and electrically connect the upper and the lower covers with the electromagnetic shield which is electrically connected to the ground conductor disposed on the printed circuit board.

2. The electrical communication card according to claim 1, further comprising four conductive pins positioned in the connector, each of the respective pins having a first end removably connectible to a corresponding electrical contact in the media plug, and each of the respective pins having a second end being in electrical communication with circuitry on the printed circuit board.

3. The electrical communications card according to claim 1, wherein the conductive members comprise at least one cantilevered beam spring biased towards the upper cover, and at least one cantilevered beam spring biased toward the lower cover.

4. The electrical communications card according to claim 3, wherein the cantilevered beam springs are formed integral with the electromagnetic interference shield.

5. The electrical communications card according to claim 1, wherein the electromagnetic interference shield at least partly comprises a conductive material.

6. An electrical connector system for providing detachable physical coupling and electrical communication between a media cable and a miniaturized communications card, the card having a printed circuit board positioned between upper and lower conductive covers, the electrical connector system comprising:

(a) a media plug having a first end connected to the a media cable, and a second end with a tongue projecting therefrom, the tongue having at least one electrical conductor disposed therein and a retention recess formed on an outer surface of the tongue;

(b) a connector, positioned on the communications card, comprising;

(i) a connector body, the connector body defining an aperture that is sized and shaped so as to detachably receive at least a portion of the media plug;

(ii) a beam terminating at a free end that is biased in a direction so as to be at least partially disposed within the aperture;

(iii) a retention portion formed on the free end of the beam that is sized and shaped so as to be removably positioned within the retention recess when the plug is detachably received within the connector aperture;

(iv) a platform extending within the connector aperture opposite the retention beam;

(v) at least one electrical lead having a first end electrically connected to the printed circuit board, and a second end that is placed in electrical contact with the media plug electrical conductor when the plug is received with the aperture; and (vi) an electromagnetic interference shield, the shield wrapping substantially around the connector body and fixed to the connector body so as to leave the aperture of the connector body exposed to receive the media plug.

7. The electrical connector system according to claim 6, wherein the electromagnetic interference shield at least partly comprises conductive material.

8. The electrical connector system according to claim 6, further comprising a plurality of conductive members that are positioned on the connector so as to physically contact and electrically connect the upper and the lower covers with the electromagnetic shield which is electrically connected to a ground conductor disposed on the printed circuit board.

9. The electrical connector system according to claim 8, wherein the conductive members comprise at least one cantilevered beam spring biased towards the upper cover, and at least one cantilevered beam spring biased towards the lower cover.

10. The electrical connector system according to claim 9, wherein the cantilevered beam springs are formed integral with the electromagnetic interference shield.

* * * * *